US008031218B2

(12) United States Patent
Mochida et al.

(10) Patent No.: US 8,031,218 B2
(45) Date of Patent: Oct. 4, 2011

(54) RECORDING APPARATUS WITH A RECORD HEAD AND RECORDING METHOD USING THE RECORD HEAD

(75) Inventors: Yasuhiko Mochida, Numazu (JP); Yuji Yasui, Izunokuni (JP); Kazunori Murakami, Izunokuni (JP); Yoshimitsu Ohtaka, Suntou-gun (JP)

(73) Assignee: Toshiba Tec Kabushiki Kaisha (JP)

( * ) Notice: Subject to any disclaimer, the term of this patent is extended or adjusted under 35 U.S.C. 154(b) by 799 days.

(21) Appl. No.: 12/011,035

(22) Filed: Jan. 23, 2008

(65) Prior Publication Data

US 2008/0174654 A1 Jul. 24, 2008

(30) Foreign Application Priority Data

Jan. 24, 2007 (JP) ..... 2007-014111

(51) Int. Cl.
*B41J 2/435* (2006.01)
*B41J 2/47* (2006.01)

(52) U.S. Cl. ..... 347/235; 347/250

(58) Field of Classification Search ..... 347/229, 347/234–238, 246–250
See application file for complete search history.

(56) References Cited

U.S. PATENT DOCUMENTS 5,089,908 A * 2/1992 Jodoin et al. ..... 359/204.1
5,835,280 A * 11/1998 Griffith ..... 359/662
5,920,680 A * 7/1999 Inoue et al. ..... 358/1.1
5,923,825 A 7/1999 Orlicki et al.
6,683,640 B1 1/2004 Sasaki et al.
6,829,020 B2 * 12/2004 Kotani et al. ..... 349/2

FOREIGN PATENT DOCUMENTS

| | | |
|---|---|---|
| CN | 1660601 | 8/2005 |
| EP | 0 795 997 | 9/1997 |
| EP | 1 552 952 | 7/2005 |
| EP | 1 564 007 | 8/2005 |
| JP | 62-078964 | 4/1987 |
| JP | 04-197647 | 7/1992 |
| JP | 05-238023 | 9/1993 |
| JP | 3446316 | 7/1995 |
| JP | 2001-341429 | 12/2001 |
| JP | 2002-113889 | 4/2002 |
| JP | 2004-249541 | 9/2004 |

OTHER PUBLICATIONS

Japanese Office Action for Application No. 2007-014111 dated Jul. 12, 2011 with English Translation (9 pages).

* cited by examiner

*Primary Examiner* — Hai C Pham
(74) *Attorney, Agent, or Firm* — Harness, Dickey & Pierce, P.L.C.

(57) ABSTRACT

The laser beam output from each of the semiconductor lasers is applied to the same print dot, such as each of the print dots on a thermosensitive recording medium, in such a manner that the laser beams are superimposed on one another sequentially at the same time that each of the semiconductor lasers is moved in the main scanning direction.

20 Claims, 10 Drawing Sheets

RECORDING APPARATUS WITH A RECORD HEAD AND RECORDING METHOD USING THE RECORD HEAD

CROSS-REFERENCE TO RELATED APPLICATIONS

This application is based upon and claims the benefit of priority from prior Japanese Patent Application No. 2007-014111, filed Jan. 24, 2007, the entire contents of which are incorporated herein by reference.

BACKGROUND OF THE INVENTION

1. Field of the Invention

This invention relates to a recording apparatus with a record head which is composed of a plurality of recording elements arranged in a line and which records two-dimensional image or other information on a recording medium, and to a recording method using the record head.

2. Description of the Related Art

An array head is a record head composed of a plurality of recording elements arranged in a line. Recording methods using an array head are, for example, of the following two types. A first method is to arrange in parallel with the main scanning direction an array head which has the same length as that of the main scanning range like a thermal head, transport a recording medium, such as recording paper, in the vertical scanning direction perpendicular to the main scanning direction with respect to the array head, thereby recording two-dimensional or other information on the recording medium.

A recording method using a thermal head has been disclosed in, for example, Jpn. Pat. Appln. KOKAI Publication No. 2001-341429. Jpn. Pat. Appln. KOKAI Publication No. 2001-341429 has disclosed an initializing method and a rewriting method of obtaining good recorded images without residual images (uneven development) in rewriting the images on a reversible thermosensitive recording medium, and an apparatus for the methods. Jpn. Pat. Appln. KOKAI Publication No. 2001-341429 has described the operation of causing the thermal head to heat to the color developing temperature the entire surface or recording area of the reversible thermosensitive recording medium to be colored or decolored according to the difference in heating temperature or cooling speed after heating to color the entire surface or recording area, thereby uniformizing the recording layer.

A second method is to provide an array head composed of a plurality of recording elements arranged in a line in parallel with a direction in which a recording medium, such as a recording sheet, is transported, stop transporting the recording medium temporarily and cause the array head to scan in the main scanning direction perpendicular to the transporting direction of the recording medium to record a plurality of lines of image or other information on the recording medium at the same time, and then transport the recording medium over a distance corresponding to a plurality of lines and record a plurality of lines of image or other information on the recording medium repeatedly, thereby recording two-dimensional image or other information on the recording medium.

On the other hand, the following two methods of recording involve causing the laser beam output from a laser light source to scan in the main scanning direction. A third method is used in, for example, a laser printer. The third method is to apply to a polygon mirror 2 the laser beam output from a single laser light source 1, such as a semiconductor laser, as shown in FIG. 18, to cause the laser beam to scan in the main scanning direction A by the rotation or reciprocating movement of the polygon mirror 2 and at the same time, and transport, for example, a rewritable thermosensitive recording medium 3 capable of thermosensitive recording in the vertical scanning direction B, thereby recording two-dimensional image or other information on the thermosensitive recording medium 3.

A fourth method uses a semiconductor laser array 4 composed of a plurality of laser light sources arranged in a line as shown in FIG. 19. The fourth method is to cause the semiconductor laser array 4 to scan in the main scanning direction and at the same time, transport a thermosensitive recording medium 3 in the vertical scanning direction, thereby recording two-dimensional image or other information on the thermosensitive recording medium 3.

The thermosensitive recording medium 3 is a rewritable reversible medium which alternates between coloring and decoloring by specific temperature heating control and enables thermosensitive recording and thermosensitive erasing. FIG. 20 shows a coloring and erasing characteristic of the thermosensitive recording medium 3. When being heated to, for example, a melting point of 180° C. or higher, the thermosensitive recording medium 3 goes into a state where the dyes in the print layer and a developer are mixed with one another. Rapid cooling from this state causes the dyes and developer to be crystallized while they are mixed with one another, thereby producing colors. On the other hand, when the thermosensitive recording medium 3 is cooled slowly, the dyes and developer crystallize separately. As a result, the thermosensitive recording medium 3 cannot keep the colored state and goes into the erased state. Moreover, even at a temperature equal to or lower than the melting point of the dyes and developer, if the thermosensitive recording medium 3 is heated at this temperature for a specific period of time, the dyes and developer are separated from one another and crystallize, with the result that the thermosensitive recording medium 3 goes into the erased state. The erase temperature at this time is in the range of about 130° C. to 170° C. As described above, with the thermosensitive recording medium 3, information is printed and erased by controlling the temperature and time exactly.

However, in the first method, since the thermal head is brought into contact with the thermosensitive recording paper, the protective layer of the thermosensitive recording paper might be damaged.

In the second method, the transportation of the recording medium has to be stopped temporarily each time a plurality of lines of image or other information are recorded simultaneously onto the recording medium. Therefore, the second method is not suitable for high-speed recording.

In the third method using the single laser light source 1, as shown in FIG. 18, when the laser beam is caused to scan the thermosensitive recording medium 3 to record information, the power of the laser beam output from the laser light source 1 is so low that it takes time to heat the recording surface of the thermosensitive recording medium 3 to the color developing temperature and therefore the speed of recording to the thermosensitive recording medium 3 cannot be increased. It is conceivable that the speed of recording to the thermosensitive recording medium 3 is increased by using, for example, a high-power semiconductor laser as the laser light source 1. However, the beam diameter of the laser beam output from the high-power semiconductor laser cannot be narrowed down to a small value and therefore fine print dots cannot be formed on the thermosensitive recording medium 3. When a high-power gas laser is used, the apparatus is large in size and requires a large power supply capacity, which increases costs.

It is conceivable that a plurality of single semiconductor lasers are used and the individual laser beams output from the semiconductor lasers are superimposed on one another to increase the power of the laser beams. However, it is difficult to align the plurality of laser beams with one another to superimpose them. The number of laser beams which can be superimposed on one another is limited to 2 to 4. Superimposing more laser beams than this number increases the difficulty.

Like the fourth method, a method of using a semiconductor laser array 4 composed of a plurality of laser light sources arranged in a line can be considered. However, in the fourth method, when the main scanning range is set to, for example, a 4-inch width with 200 DPI, a semiconductor laser array 4 composed of 800 laser light sources arranged in a line is required, which naturally increases costs.

It is, accordingly, an object of the invention to provide a recording apparatus with a record head capable of realizing a high-speed recording operation without a significant increase in costs.

BRIEF SUMMARY OF THE INVENTION

According to a first aspect of the invention, there is provided a recording apparatus with a record head comprising: a record head which is composed of a plurality of recording elements arranged in a line; a transport mechanism which transports a recording medium; a recording control unit which not only causes the record head to scan in a main scanning direction but also drives the transport mechanism to transport the recording medium in a vertical scanning direction perpendicular to the main scanning direction of the record head and records information on the recording medium; and a drive timing control unit which selectively drives each of the recording elements and concentrates the recording operation of each of the recording elements on a printing place of the information on the recording medium.

According to a second aspect of the invention, there is provided a recording method using a record head comprising: when in a record head composed of a plurality of recording elements arranged in a line, each of the recording elements is caused to scan in a main scanning direction and at the same time, a recording medium is transported in a vertical scanning direction perpendicular to the main scanning direction of the record head to record information on the recording medium, selectively driving each of the recording elements and concentrating the recording operation of each of the recording elements a place at which the information is printed on the recording medium.

DETAILED DESCRIPTION OF THE INVENTION

Figure 18:
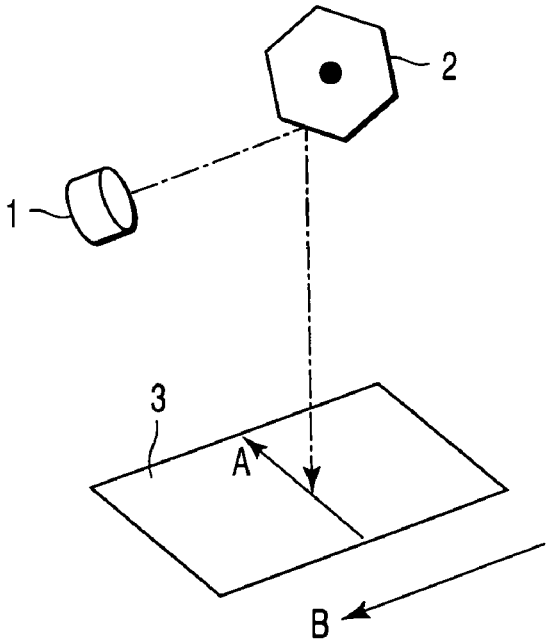
FIG. 18 PRIOR ART
FIG. 18 shows a recording method using a conventional laser beam.
Figure 19:
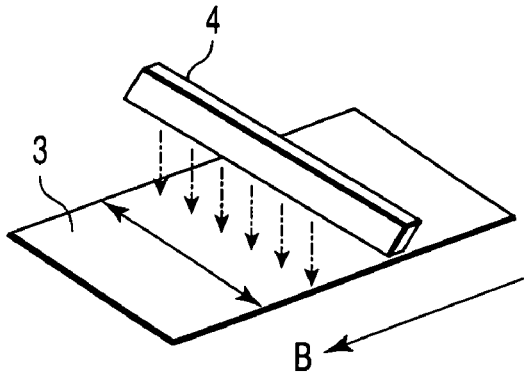
FIG. 19 PRIOR ART
FIG. 19 shows a recording method using a record head composed of a plurality of conventional laser light sources arranged in a line.

Hereinafter, referring to the accompanying drawings, a first embodiment of the invention will be explained. The same parts as those of FIG. 18 are indicated by the same reference numerals and a detailed explanation of them will be omitted.

Figure 1:
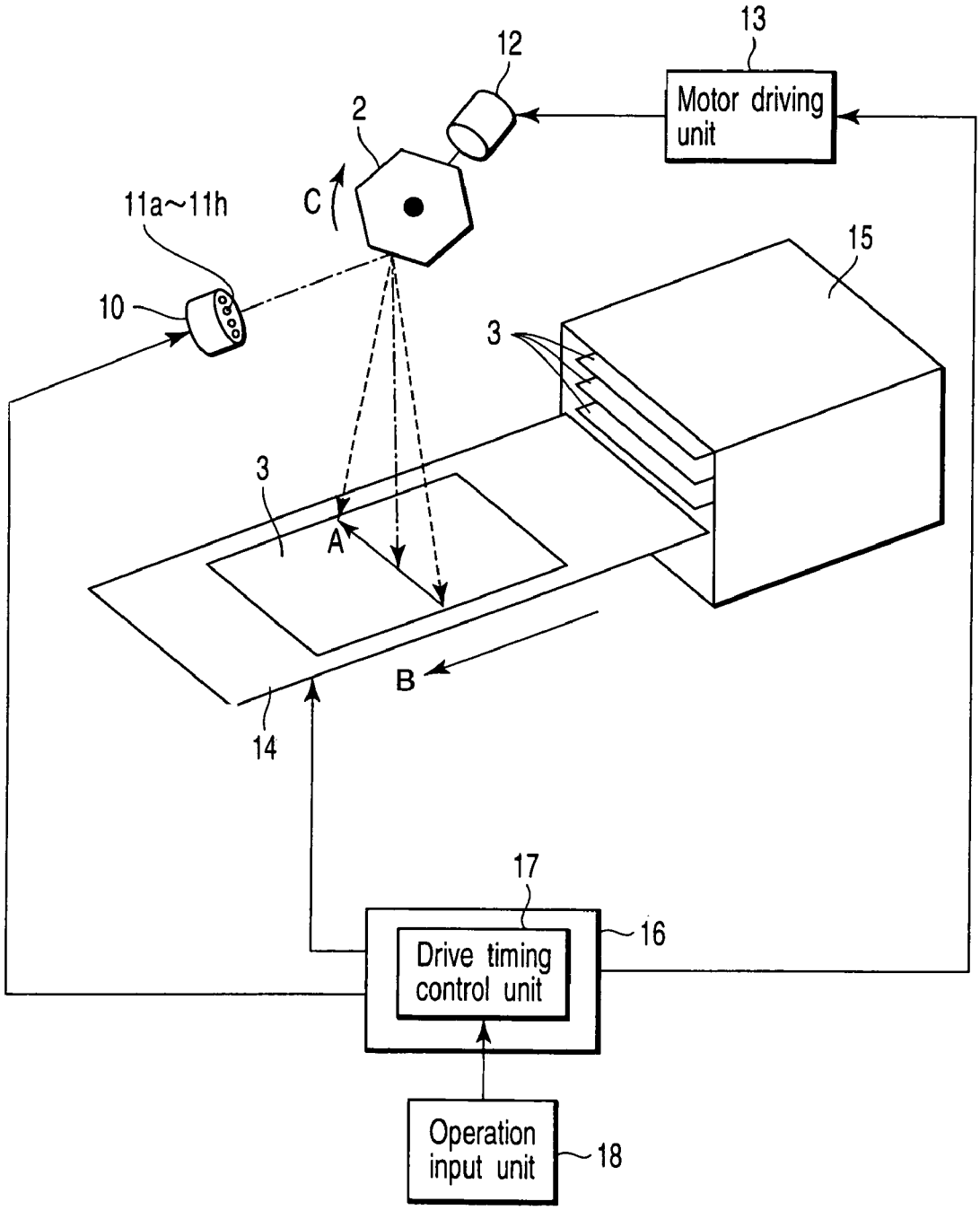
FIG. 1 shows the configuration of a first embodiment of a recording apparatus according to the invention.
Figure 2:
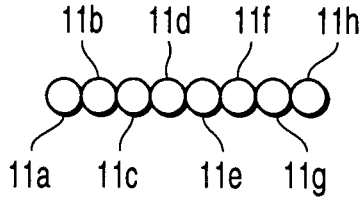
FIG. 2 shows the configuration of a laser array head composed of a plurality of semiconductor lasers arranged in a line in the recording apparatus.

FIG. 1 shows the configuration of a recording apparatus. A laser array head 10 is provided as a record head. The laser array head 10 is composed of a plurality of recording elements, such as laser light sources, for example, 8 semiconductor lasers 11*a* to 11*h*, arranged in a line as shown in FIG. 2. Each of the semiconductor lasers 11*a* to 11*h* outputs a laser beam. On the optical path of the laser beam output from each of the semiconductor lasers 11*a* to 11*h*, for example, a polygon mirror 2 is provided. The polygon mirror 2 is driven by a motor 12 and rotates in the direction of arrow C. Rotating in the direction of arrow C, the polygon mirror 2 causes the laser beam output from each of the semiconductor lasers 11*a* to 11*h* to scan in the main scanning direction A. The motor 12 is rotated by a motor driving unit 13. The range in which the laser beam caused to scan in the main scanning direction A by the polygon mirror 2 is not limited to the surface of the thermosensitive recording medium 3. For instance, the laser beam could be made to scan outside the surface of the thermosensitive recording medium 3.

On a transport mechanism 14, for example, a thermosensitive recording medium 3 is placed. As described above, the thermosensitive recording medium 3 is a rewritable reversible medium which alternates between coloring and decoloring by specific temperature heating control and enables thermosensitive recording and thermosensitive erasing. The transport mechanism 14 transports the thermosensitive recording medium 3 in the vertical scanning direction B. The main scanning direction A and the vertical scanning direction B cross at right angles. A recording medium storage box 15 is located upstream of the transport mechanism 14. In the recording medium storage box 15, a plurality of thermosensitive recording mediums 3 are housed. The thermosensitive recording mediums 3 housed in the recording medium storage box 15 are picked up, for example, one by one and placed on the transport mechanism 14.

A recording control unit 16 drives the laser array head 10 to cause the laser beam output from each of the semiconductor lasers 11*a* to 11*h* to scan in the main scanning direction A. At the same time, the recording control unit 16 drives the transport mechanism 14 to transport the thermosensitive recording medium 3 in the vertical scanning direction B perpendicular to the main scanning direction A, thereby recording information onto the thermosensitive recording medium 3. That is, the recording control unit 16 gives a drive instruction to rotate the polygon mirror 2 to the motor driving unit 13. At the same time, the recording control unit 16 gives an instruction to transport the thermosensitive recording medium 3 to the transport mechanism 14. The recording control unit 16 is composed of a computer including a CPU, ROM, RAM and the like. In the recording control unit 16, a drive timing control unit 17 operates as a result of the execution of a drive timing control program previously stored in, for example, the ROM.

The drive timing control unit 17 selectively drives the individual semiconductor lasers 11*a* to 11*h* to concentrate the recording operation of each of the semiconductor lasers 11*a* to 11*h* at the information printing place, or the print dot place, on the thermosensitive recording medium 3. That is, the drive timing control unit 17 superimposes the laser beam output from each of the semiconductor laser beams 11*a* to 11*h* on one another at the same print dot on the thermosensitive recording medium 3. When each laser beam is applied to the thermosensitive recording medium 3 in such a manner that the beams are superimposed on one another at the print dot, heat is concentrated at the print dot place to which the individual lasers are applied so as to be superimposed onto one another sequentially, thereby heating the print dot place. As a result, the print dot place reaches, for example, the color developing temperature (e.g., 180° C.) shown in FIG. 20.

Specifically, the drive timing control unit 17 determines for each of the semiconductor lasers 11*a* to 11*h* whether the scanning position of the laser beam output from each of the semiconductor lasers 11*a* to 11*h* has reached a position corresponding to the same print dot place on the thermosensitive recording medium 3 sequentially. If the result of the determination has shown that the scanning position of the laser beam output from each of the semiconductor lasers 11*a* to 11*h* has reached the position corresponding to the same print dot place on the thermosensitive recording medium 3 sequentially, the drive timing control unit 17 causes each of the semiconductor lasers 11*a* to 11*h* to output a laser beam sequentially, applying the individual layer beams to the same print dot place in such a manner that the beams are superimposed on one another at the print dot place sequentially.

The drive timing control unit 17 recognizes the print dot place on the thermosensitive recording medium 3 on the basis of image data including images and characters and selectively drives each of the semiconductor lasers 11*a* to 11*h* according to the print dot place.

According to the speed at which the thermosensitive recording medium 3 is transported by the transport mechanism 14, the drive timing control unit 17 can vary the operation of recording onto the thermosensitive recording medium 3, that is, the speed at which the laser beam output from each of the semiconductor lasers 11*a* to 11*h* is caused to scan in the main scanning direction A by the polygon mirror 2. For example, as the transport speed of the thermosensitive recording medium 3 increases, the scanning speed of each laser beam in the main scanning direction A increases. As the transport speed of the thermosensitive recording medium 3 decreases, the scanning speed of each laser beam in the main scanning direction A decreases. Therefore, according to the transport speed of the thermosensitive recording medium 3, the timing with which printing is done at each print dot on the thermosensitive recording medium 3 varies.

An operation input unit 18 is for handling the start of the operation of recording on the thermosensitive recording medium 3 or the number of records. The operation input unit 18 may input information to be recorded on the thermosensitive recording medium 3.

Next, the recording operation of the apparatus configured as described above will be explained.

The individual thermosensitive recording mediums 3 housed in the recording medium storage box 15 are picked up, for example, one by one and placed on the transport mechanism 14. The transport mechanism 14, on which the thermosensitive recording medium 3 is placed, transports the thermosensitive recording medium 3 in the vertical scanning direction B. At this time, the thermosensitive recording medium 3 put on the transport mechanism 14 has no image or other data recorded on it at all.

Figure 3:
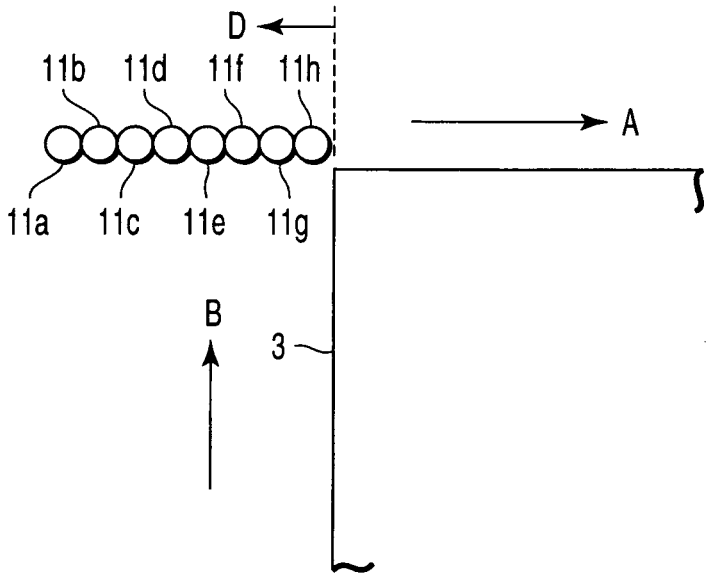
FIG. 3 shows the projection positions on a thermosensitive recording medium of the individual semiconductor lasers before the operation of recording onto a thermosensitive recording medium in the recording apparatus.

Before the start of the operation of recording on the thermosensitive recording medium 3, the scanning position of the laser beam output from each of the semiconductor lasers 11*a* to 11*h* is located at a position D outside the surface of the thermosensitive recording medium 3 as shown in FIG. 3.

Figure 4:
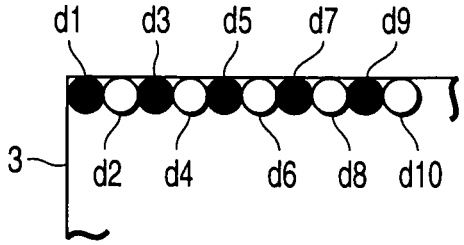
FIG. 4 shows the individual print dots to be printed on the thermosensitive recording medium by the recording apparatus.

Hereinafter, explanation will be given using a case where print dots d1 to d9 which alternate between printing and nonprinting in the main scanning direction A on the thermosensitive recording medium 3 as shown in FIG. 4 are to be printed.

When the operation of recording on the thermosensitive recording medium 3 is started, the drive timing control unit 17 recognizes, for example, the print dots d1, d3, d5, d7, d9 on the thermosensitive recording medium 3 on the basis of the image data including images and characters. According to the print dots d1, d3, d5, d7, d9, the drive timing control unit 17 selectively drives each of the semiconductor lasers 11*a* to 11*h*.

At the same time, the drive timing control unit 17 gives to the motor driving unit 13 a drive instruction to rotate the polygon mirror 2 in the direction of arrow C. As a result, the scanning position of the laser beam output from each of the semiconductor lasers 11*a* to 11*h* moves in the main scanning direction sequentially.

Figure 5:
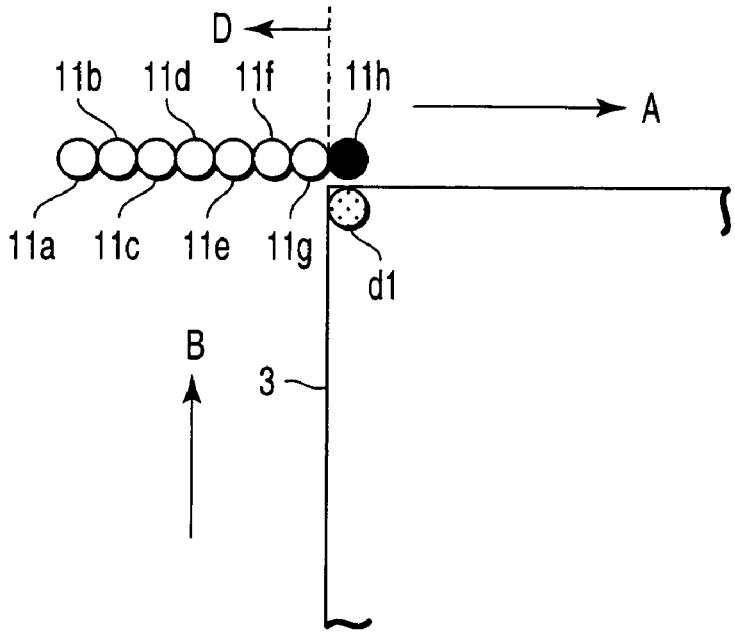
FIG. 5 shows the process of printing the individual print dots onto the thermosensitive recording medium in the recording apparatus.

For example, if 4-inch wide, 200-DPI printing is realized with 1.6 ms/line (2 μs/dot), when 2 us has elapsed since the operation of recording on the thermosensitive recording medium 3 was started, the scanning position of the laser beam output from the semiconductor laser 11*h* moves to a position adjacent to the edge of the thermosensitive recording medium 3 and inside the edge as shown in FIG. 5. At this time, the drive timing control unit 17 drives only the semiconductor laser 11*h* and does not drive the other semiconductor lasers 11*a* to 11*g*. This causes the laser beam output from the semiconductor laser 11*h* to be reflected by the polygon mirror 2 and applied to the print dot d1.

Figure 6:
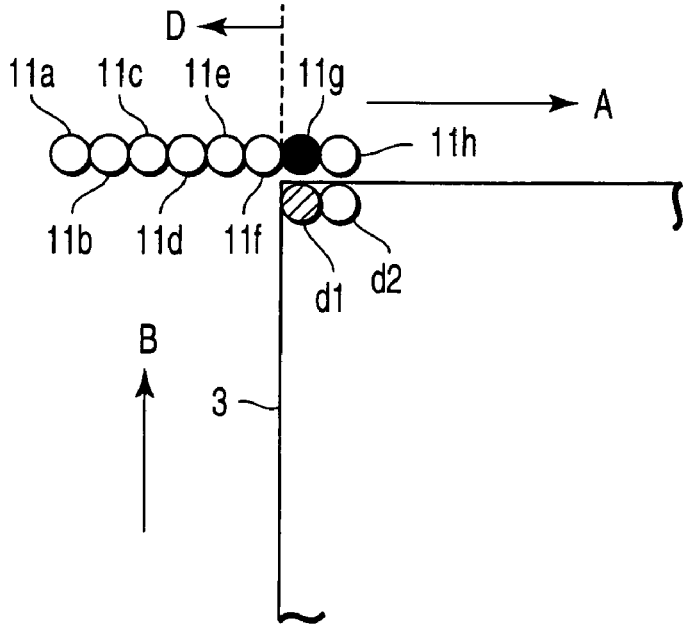
FIG. 6 shows the process of printing the individual print dots onto the thermosensitive recording medium in the recording apparatus.

Next, when 4 μs has elapsed since the operation of recording on the thermosensitive recording medium 3 was started, the scanning position of the laser beam output from each of the semiconductor lasers 11*g*, 11*h* is located on the recording surface of the thermosensitive recording medium 3 as shown in FIG. 6. At this time, the drive timing control unit 17 drives only the semiconductor laser 11*g* and does not drive the other semiconductor lasers 11*a* to 11*f*, 11*h*. This causes the laser beam output from the semiconductor laser 11*g* to be reflected by the polygon mirror 2 and applied to the print dot d1. As a result, at the print dot d1, the laser beam from the semiconductor laser 11*g* is superimposed on the laser beam from the semiconductor laser 11*h* which has already been applied to the print dot d1.

Figure 7:
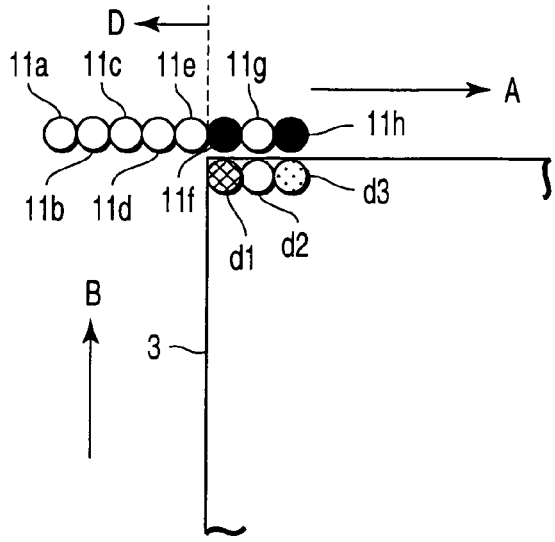
FIG. 7 shows the process of printing the individual print dots onto the thermosensitive recording medium in the recording apparatus.

Next, when 6 μs has elapsed since the operation of recording on the thermosensitive recording medium 3 was started, the scanning position of the laser beam output from each of the semiconductor lasers 11*f*, 11*g*, 11*h* is located on the recording surface of the thermosensitive recording medium 3 as shown in FIG. 7. At this time, the drive timing control unit 17 drives the semiconductor lasers 11*f*, 11*h* and does not drive the other semiconductor lasers 11*a* to 11*e*, 11*g*. This causes the laser beam output from the semiconductor laser 11*h* to be reflected by the polygon mirror 2 and applied to the print dot d3. At the same time, the laser beam output from the semiconductor laser 11*f* is reflected by the polygon mirror 2 and applied to the print dot d1. As a result, at the print dot d1, the laser beam from the semiconductor laser 11*f* is superimposed on the laser beam from each of the semiconductor lasers 11*h*, 11*g* which has been already applied to the print dot d1.

Figure 8:
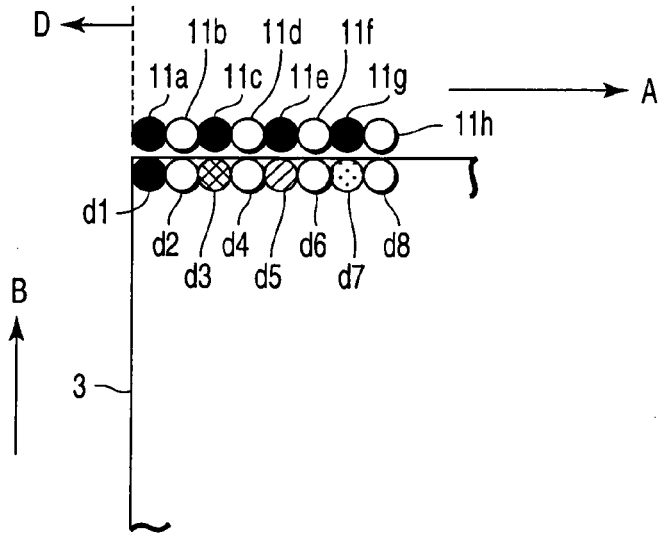
FIG. 8 shows the process of printing the individual print dots onto the thermosensitive recording medium in the recording apparatus.

Hereinafter, similarly, each time 2 μs has elapsed, the drive timing control unit 17 selectively drives each of the semiconductor lasers 11*a* to 11*h* according to the print dots d1, d3, d5, d7, d9. As a result, when 16 μs has elapsed since the operation of recording on the thermosensitive recording medium 3 was started, the scanning position of the laser beam output from each of the semiconductor lasers 11*a* to 11*h* is located on the print face of the thermosensitive recording medium 3 as shown in FIG. 8. That is, the scanning position of the laser beam output from the semiconductor laser 11*a* among the semiconductor lasers 11*a* to 11*h* is located at a position adjacent to the edge of the thermosensitive recording medium 3 and inside the edge.

Here, regarding the print dot d1, the laser beams output sequentially from each of the semiconductor lasers 11*a* to 11*h* are applied to the print dot d1 in such a manner that individual laser beams are superimposed on one another consecutively. That is, a total of 8 laser beams are applied to the print dot d1 consecutively. As a result, the print dot d1 receives a laser power eight times the laser power generated by the application of a laser beam from a single semiconductor laser. Consequently, heat is concentrated on the print dot d1, thereby heating the dot d1, which then reaches the color developing temperature (e.g., 180° C.) shown in FIG. 20. Accordingly, at the print dot d1, printing is completed with a sufficient density.

Figure 9:
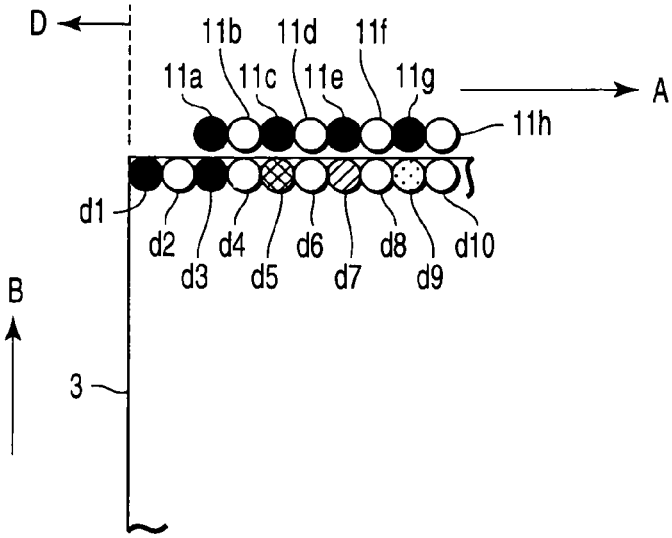
FIG. 9 shows the process of printing the individual print dots onto the thermosensitive recording medium in the recording apparatus.

When 20 μs has elapsed since the operation of recording on the thermosensitive recording medium 3 was started, the scanning position of the laser beam output from each of the semiconductor lasers 11*a* to 11*h* moves further in the main scanning direction A. For example, the scanning position of the laser beam output from the semiconductor laser 11*a* moves to a position corresponding to the print dot d3 as shown in FIG. 9. At this time, a total of 8 laser beams are applied to the print dot d3 consecutively. Accordingly, the print dot d3 similarly receives a laser power eight times the laser power generated by the application of a laser beam from a single semiconductor laser. As a result, heat is concentrated on the print dot d3 like the print dot d1, thereby heating the dot d3, which then reaches the color developing temperature (e.g., 180° C.) shown in FIG. 20. Accordingly, at the print dot d3, printing is completed with a sufficient density.

Hereinafter, similarly, each of the semiconductor lasers 11*a* to 11*h* is selectively driven according to the individual print dots d1, d3, d5, d7, d9, and the like, which causes the scanning position of the laser beam output from each of the semiconductor lasers 11*a* to 11*h* to scan by one line in the main scanning direction A. After the scanning of one line in the main scanning direction A is completed, for example, one line of print dots d1, d3, d5, d7, d9 is formed as shown in FIG. 4.

In the first embodiment, the scanning position of the laser beam output from each of the semiconductor lasers 11*a* to 11*h* is moved in the main scanning direction A and at the same time, the laser beam output from each of the semiconductor lasers 11*a* to 11*h* is applied to the same print dot, for example, each of the print dots d1, d3, d5, d7, d9 sequentially in such a manner that the individual laser beams are superimposed on one another. This makes it possible to realize a high-speed recording operation without a substantial rise in costs merely by using the laser array head 10 composed of the minimum necessary number of inexpensive semiconductor lasers, for example, 8 semiconductor lasers 11*a* to 11*h*, arranged in a line without using a laser apparatus, such as a high-power gas laser.

The drive timing control unit 17 causes the laser beam output from each of the semiconductor lasers 11*a* to 11*h* to be superimposed on one another at each of the print dots d1, d3, d5, d7, d9 on the thermosensitive recording medium 3. As a result of the superimposed application of the individual laser beams, the temperature at each of the print dots d1, d3, d5, d7, d9 is heated to the color developing temperature (e.g., 180° C.). Accordingly, each of the semiconductor lasers 11*a* to 11*h* need not have a high laser power. By superimposing the laser beams output from the semiconductor lasers 11*a* to 11*h* on one another, the individual print dots d1, d3, d5, d7, d9 are printed with a sufficient density.

While the number of semiconductor lasers 11*a* to 11*h* was, for example, 8 in the explanation, the invention is not limited to this. The number of semiconductor lasers may be increased or decreased according to the magnitude of the laser power of each of the semiconductor lasers.

Next, a second embodiment of the invention will be explained with reference to the accompanying drawings. The same parts as those of FIG. 1 are indicted by the same reference numerals and a detailed explanation of them will be omitted.

Figure 10:
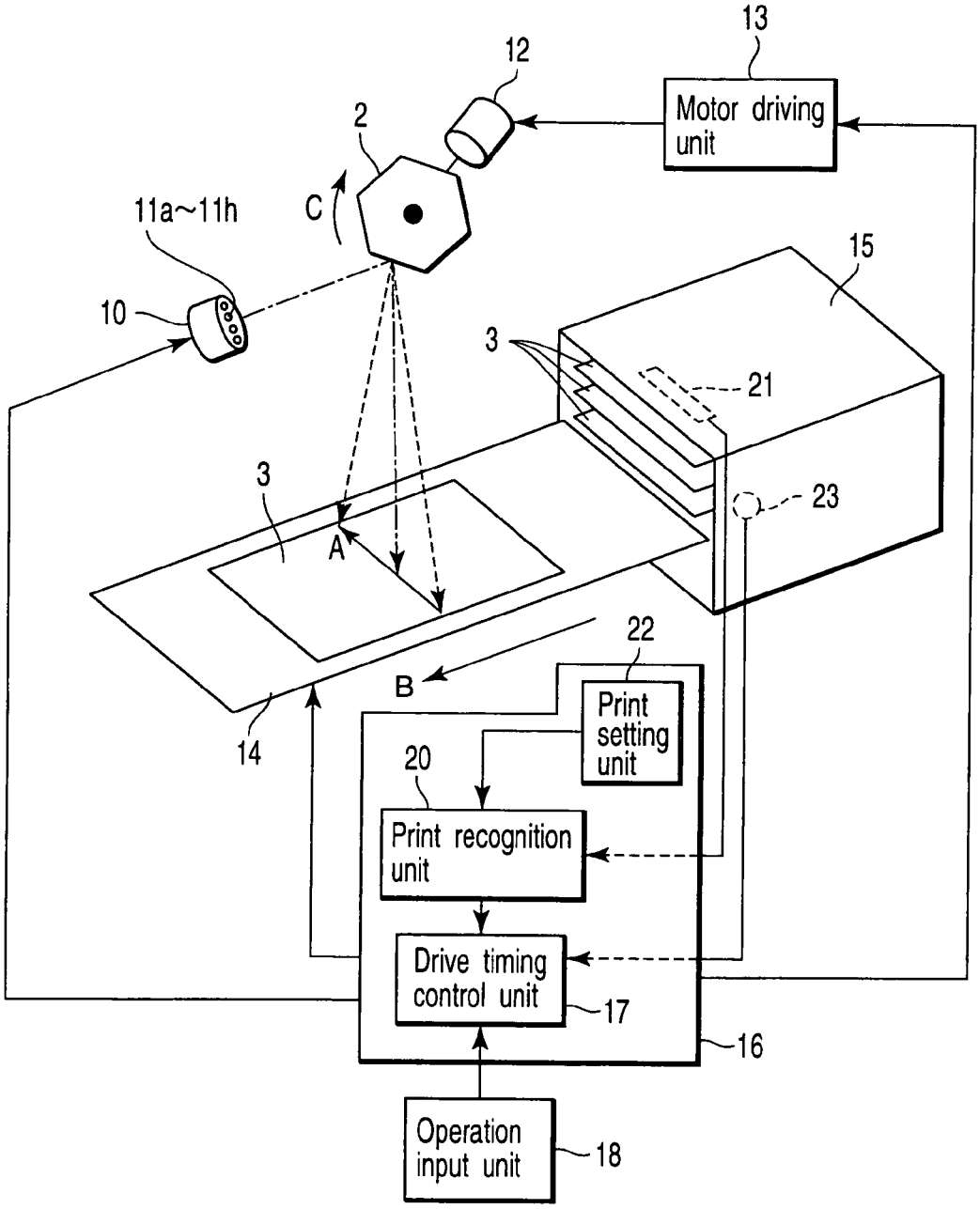
FIG. 10 shows the configuration of a second embodiment of the recording apparatus according to the invention.

FIG. 10 shows the configuration of a recording apparatus according to the second embodiment. A print recognition unit 20 is connected to the drive timing control unit 17. A print face sensor 21 and a print setting unit 22 are connected to the print recognition unit 20. The print face sensor 21 is provided in, for example, the recording medium storage box 15. The print face sensor 21 senses the state of the print face of the thermosensitive recording medium 3 housed in, for example, the recording medium storage box 15 and outputs a sense signal. For example, an image sensor is used as the print face sensor 21.

For example, the operator manually sets in the print setting unit 22 information about whether the print of data (hereinafter, referred to as an existing print) is already present on the print face of the thermosensitive recording medium 3 housed in the recording medium storage box 15.

The sense signal output from the print face sensor 21 is input to the print recognition unit 20. The print recognition unit 20 then determines whether an existing print is present on the print face of the thermosensitive recording medium 3, on the basis of, for example, the image data on the print face of the thermosensitive recording medium 3. The print recognition unit 20 senses the setting state at the print setting unit 22 and, on the basis of the result of the sensing, determines whether an existing print is present on the print face of the thermosensitive recording medium 3. The print recognition unit 20 sends to the drive timing control unit 17 the result of determining whether an existing print is present on the print face of the thermosensitive recording medium 3.

A temperature sensor 23 is provided in, for example, the recording medium storage box 15. The temperature sensor 23 senses the ambient temperature at the thermosensitive recording medium 3 housed in the recording medium storage box 15 and outputs the sense signal.

The drive timing control unit 17 receives the result of the determination at the print recognition unit 20. The result of the determination shows whether or not an existing print is present on the print face of the thermosensitive recording medium 3.

If an existing print is present on the print face of the thermosensitive recording medium 3, for example, if print dots have already been made in all of the positions of the print dots d1 to d9 on the print face of the thermosensitive recording medium 3 as shown in FIG. 4, the drive timing control unit 17 erases the existing print on the thermosensitive recording medium 3 and then records information.

Specifically, when the scanning position of the laser beam output from each of a part of the semiconductor lasers 11*a* to 11*h*, for example, semiconductor lasers 11*e* to 11*h*, has reached the position corresponding to each of the print dots d1 to d9 on the thermosensitive recording medium 3 sequentially, the drive timing control unit 17 causes each of the semiconductor lasers 11*e* to 11*h* to output a laser beam, thereby applying the laser beams to each of the print dots d1 to d9 in such a manner that the beams are superimposed on one another at each of the print dots d1 to d9 sequentially. In this way, each of the semiconductor lasers 11*a* to 11*h* is caused to output a laser beam, thereby applying the laser beams to each of the print dots d1 to d9 in such a manner that the beams are superimposed on one another at each of the print dots d1 to d9, which heats each of the print dots d1 to d9 on the thermosensitive recording medium 3 to the erase temperature shown in FIG. 20. This causes the existing print present on the recording face to be erased.

Then, when the scanning position of the laser beam output from each of the remaining semiconductor lasers 11*a* to 11*d* has reached a position corresponding to each of the print dots d1, d3, d5, d7, d9 on the thermosensitive recording medium 3 sequentially, the drive timing control unit 17 causes each of the semiconductor lasers 11*a* to 11*d* to output a laser beam, thereby applying the laser beams to each of the print dots d1, d3, d5, d7, d9 in such a manner that the beams are superimposed on one another at each of the print dots d1, d3, d5, d7, d9.

On the other hand, if the result of the determination at the print recognition unit 20 has shown that there is no existing print on the print face of the thermosensitive recording medium 3, when the scanning position of the laser beam output from each of the semiconductor lasers 11*a* to 11*h* has reached a position corresponding to the print dot place on the thermosensitive recording medium 3 sequentially, the drive timing control unit 17 causes each of the semiconductor lasers 11*a* to 11*h* to output a laser beam, thereby applying the laser beams to the print dot place in such a manner that the beams are superimposed on one another at the print dot place.

Receiving the sense signal output from the temperature sensor 23, the drive timing control unit 17 may change the number of semiconductor lasers 11*e* to 11*h* used to erase existing prints according to the ambient temperature at the thermosensitive recording medium 3 housed in the recording medium storage box 15. In this case, it has been determined that an existing print is present on the print face of the thermosensitive recording medium 3.

For example, the number of semiconductor lasers 11*e* to 11*h* used in erasing an existing print is set to 4 when the ambient temperature at the thermosensitive recording medium 3 is at a preset reference temperature. Each time the ambient temperature at the thermosensitive recording medium 3 rises or falls from the reference temperature in units of a specific temperature, the number of semiconductor lasers is increased or decreased by, for example, one. Accordingly, if the ambient temperature at the thermosensitive recording medium 3 gets higher than the reference temperature by the specific temperature, the number of semiconductor lasers outputting a laser beam is decreased by one, giving three semiconductor lasers 11*f* to 11*h*. If the ambient temperature at the thermosensitive recording medium 3 gets lower than the reference temperature by the specific temperature, the number of semiconductor lasers outputting a laser beam is increased by one, giving five semiconductor lasers 11*d* to 11*h*.

Furthermore, the drive timing control unit 17 causes each of a part of the semiconductor lasers 11*a* to 11*h*, for example, the semiconductor lasers 11*e* to 11*h*, to output a laser beam to each of the print dots d1 to d9, thereby applying the laser beams to each of the print dots d1 to d9 in such a manner that the beams are superimposed on one another at each of the print dots d1 to d9. This makes it possible to preheat the thermosensitive recording medium 3 to a temperature which has not reached the color developing temperature (e.g., 180° C.) but is close to the color developing temperature. The preheating of the thermosensitive recording medium 3 can be realized by increasing or decreasing the number of semiconductor lasers 11*e* to 11*h* caused to output laser beams by, for example, the drive timing control unit 17 or by using semiconductor lasers 11*a* to 11*h* with a lower laser power.

Next, explanation will be given using a case where print dots d1 to d9 which alternate between printing and nonprinting in the main scanning direction A on the thermosensitive recording medium 3 as shown in FIG. 4 are to be printed.

Figure 11:
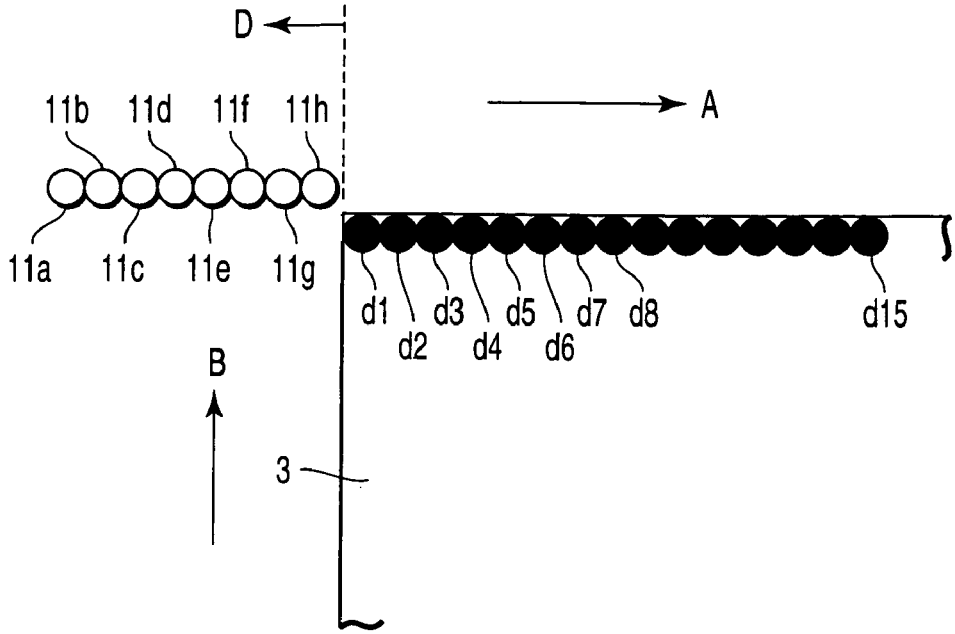
FIG. 11 shows the process of printing the individual print dots onto the thermosensitive recording medium in the recording apparatus.

On the print face of the thermosensitive recording medium 3 housed in the recording medium storage box 15, for example, a print of a horizontal ruled line is already present as shown in FIG. 11. Moreover, before the operation of recording onto the thermosensitive recording medium 3, the scanning position of the laser beam of each of the semiconductor lasers 11*a* to 11*h* is located at a position D outside the surface of the thermosensitive recording medium 3 as shown in FIG. 11. The horizontal ruled line is formed of a colored line of print dots d1 to d15. The print face sensor 21 senses the state of the print face of the thermosensitive recording medium 3 housed in, for example, the recording medium storage box 15 and outputs the sense signal. Alternately, for example, the operator manually sets in the print setting unit 22 information about the presence of an existing print on the print face of the thermosensitive recording medium 3 housed in the recording medium storage box 15.

The sense signal output from the print face sensor 21 is input to the print recognition unit 20. The print recognition unit 20 then determines whether an existing print is present on the print face of the thermosensitive recording medium 3, on the basis of, for example, the image data on the print face of the thermosensitive recording medium 3. Moreover, the print recognition unit 20 senses the setting state at the print setting unit 22 and, on the basis of the result of the sensing, determines whether an existing print is present on the print face of the thermosensitive recording medium 3. The print recognition 20 sends to the drive timing control unit 17 the result of determining whether an existing print is present on the print face of the thermosensitive recording medium 3.

Receiving from the print recognition unit 20 the result of the determination which has shown that an existing print is present on the print face of the thermosensitive recording medium 3, the drive timing control unit 17 erases the existing print on the thermosensitive recording medium 3 and then records information. Specifically, to erase the existing print, the drive timing control unit 17 drives each of a part of the semiconductor lasers 11*a* to 11*h*, for example, the semiconductor lasers 11*e* to 11*h* for each of the print dots d1 to d9 and causes each of the semiconductor lasers 11*e* to 11*e* to output a laser beam.

Next, to write information, when the scanning position of the laser beam output from each of the remaining semiconductor lasers 11*a* to 11*d* has reached a position corresponding to each of the print dots d1, d3, d5, d7, d9 on the thermosensitive recording medium 3, the drive timing control unit 17 causes each of the semiconductor lasers 11*a* to 11*d* to output a laser beam sequentially, thereby applying the laser beams to the print dot sequentially in such a manner that the beams are superimposed on one another at the print dot.

Hereinafter, a concrete explanation will be given. When the operation of recording onto the thermosensitive recording medium 3 is started, the drive timing control unit 17 causes each of the semiconductor lasers 11*a* to 11*h* to output a laser beam for each of the print dots d1 to d9 to erase the existing print. Then, to record information, the drive timing control unit 17 recognizes, for example, the print dots d1, d3, d5, d7, d9 on the thermosensitive recording medium 3 on the basis of image data including images and characters and, according to these print dots d1, d3, d5, d7, d9, selectively drives each of the semiconductor lasers 11*a* to 11*d*. At the same time, the drive timing control unit 17 gives the motor driving unit 13 a drive instruction to rotate the polygon mirror 2 in the direction of arrow C. As a result, the scanning position of the laser beam output from each of the semiconductor lasers 11*a* to 11*h* moves in the main scanning direction sequentially.

Figure 12:
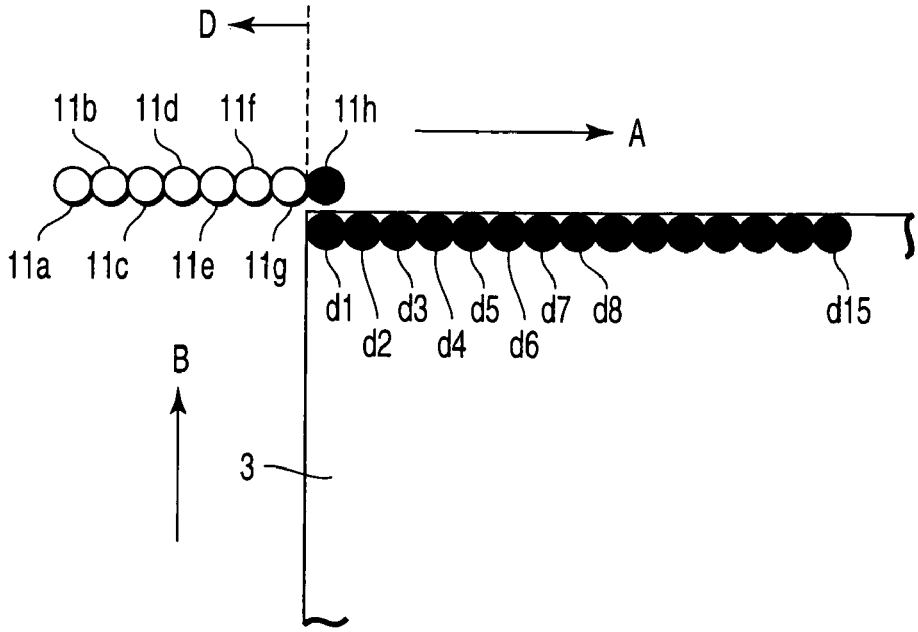
FIG. 12 shows the process of printing the individual print dots onto the thermosensitive recording medium in the recording apparatus.

For example, if 4-inch wide, 200-DPI printing is realized with 1.6 ms/line (2 μs/dot), the existing print is first erased. When 2 μs has elapsed since the operation of recording on the thermosensitive recording medium 3 was started, the scanning position of the laser beam output from the semiconductor laser 11*h* moves to a position adjacent to the edge of the thermosensitive recording medium 3 and inside the edge as shown in FIG. 12. At this time, the drive timing control unit 17 drives only the semiconductor laser 11*h* and does not drive the other semiconductor lasers 11*a* to 11*g*. This causes the laser beam output from the semiconductor laser 11*h* to be reflected by the polygon mirror 2 and applied to the print dot d1.

Figure 13:
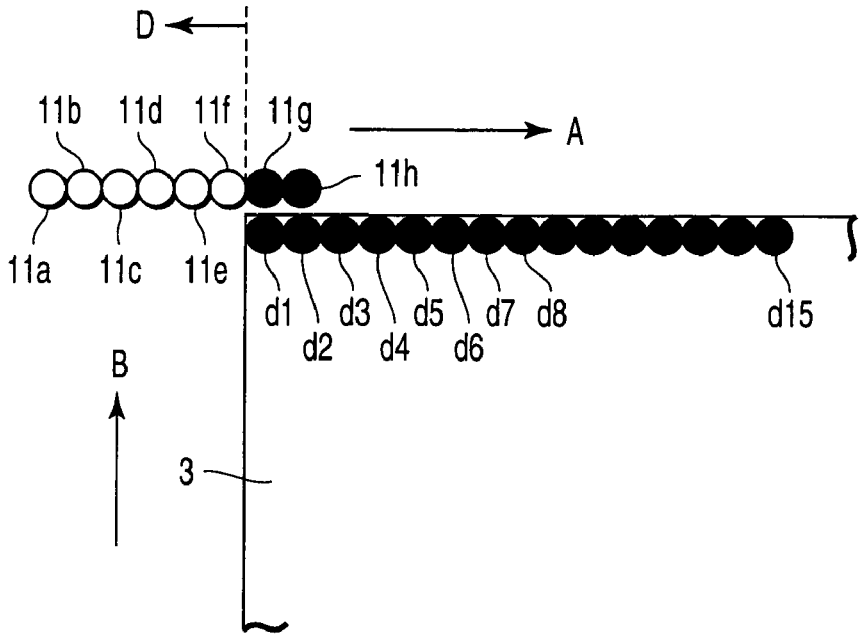
FIG. 13 shows the process of printing the individual print dots onto the thermosensitive recording medium in the recording apparatus.

Next, when 4 μs has elapsed since the operation of recording on the thermosensitive recording medium 3 was started, the scanning position of the laser beam output from each of the semiconductor lasers 11*g*, 11*h* is located on the print face of the thermosensitive recording medium 3, as shown in FIG. 13. At this time, the drive timing control unit 17 drives the semiconductor lasers 11*g*, 11*h* and does not drive the other semiconductor lasers 11*a* to 11*f*. This causes the laser beam output from each of the semiconductor lasers 11*g*, 11*h* to be reflected by the polygon mirror 2 and applied to the print dots d1, d2. As a result, at the print dot d1, the laser beam from the semiconductor laser 11*g* is superimposed on the laser beam from the semiconductor laser 11*h* which has been already applied to the print dot d1. Moreover, to the print dot d2, the laser beam from the semiconductor laser 11*h* is applied.

Figure 14:
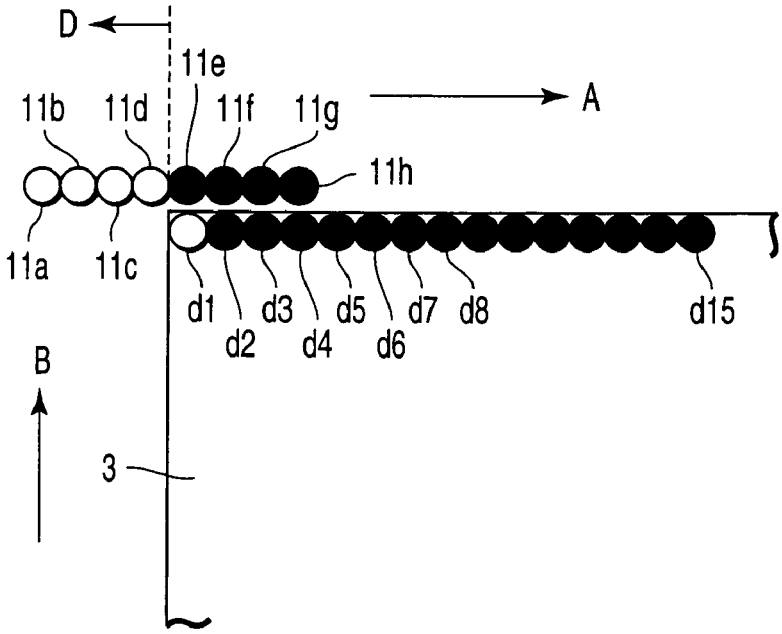
FIG. 14 shows the process of printing the individual print dots onto the thermosensitive recording medium in the recording apparatus.

Next, when 8 μs has elapsed since the operation of recording on the thermosensitive recording medium 3 was started, the scanning position of the laser beam output from each of the semiconductor lasers 11*e* to 11*h* is located on the print face of the thermosensitive recording medium 3, as shown in FIG. 14. At this time, the drive timing control unit 17 drives the semiconductor lasers 11*e* to 11*h* and does not drive the other semiconductor lasers 11*a* to 11*d*. This causes the laser beam output from each of the semiconductor lasers 11*e* to 11*h* to be reflected by the polygon mirror 2 and applied to the print dots d1 to d4. As a result, the laser beam from each of the semiconductor lasers 11*e* to 11*f* is applied to the print dot d1 in such a manner that the beams are superimposed on one another consecutively at the print dot d1.

Here, as regards the print dot d1, the laser beam output sequentially from each of the semiconductor lasers 11*e* to 11*h* is applied to the print dot d1 in such a manner that the individual laser beams are superimposed on one another consecutively. That is, a total of 4 laser beams are applied to the print dot d1 consecutively. As a result, the print dot d1 receives a laser power four times the laser power generated by the application of the laser beam from a single semiconductor laser. Consequently, heat is concentrated on the print dot d1, thereby heating the dot d1, which then reaches the erase temperature shown in FIG. 20. Accordingly, at the print dot d1, the existing print is erased as shown in FIG. 14.

At this time, the laser beam of each of the semiconductor lasers 11*f* to 11*h* is applied to the print dot d2 in such a manner that the beams are superimposed on one another consecutively at the print dot d2. Similarly, the laser beam of each of the semiconductor lasers 11*g*, 11*h* is applied to the print dot d3 in such a manner that the beams are superimposed on each other consecutively at the print dot d3. To the print dot d4, the laser beam from the semiconductor laser 11*h* is applied.

Figure 15:
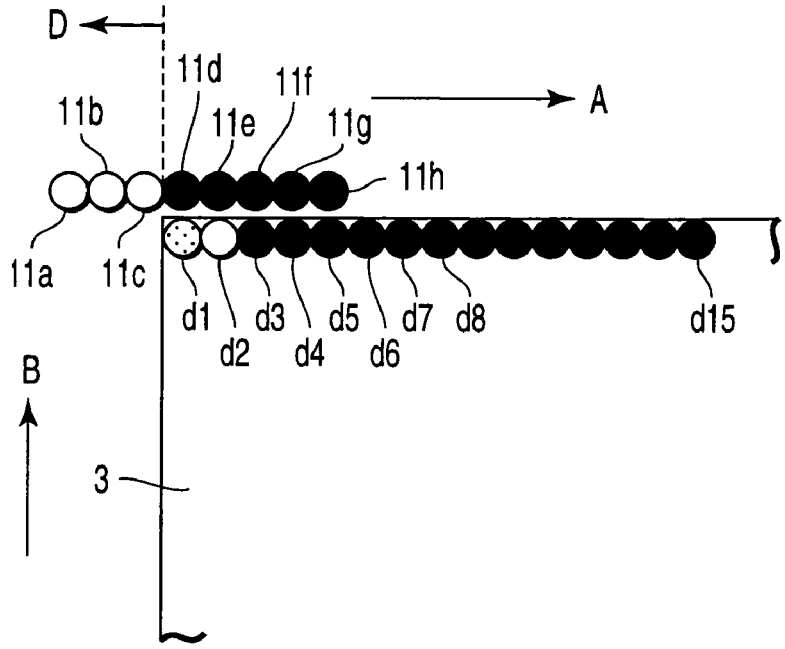
FIG. 15 shows the process of printing the individual print dots onto the thermosensitive recording medium in the recording apparatus.

Next, when 10 μs has elapsed since the operation of recording onto the thermosensitive recording medium 3 was started, the scanning position of the laser beam output from each of the semiconductor lasers 11*d* to 11*h* is located on the print face of the thermosensitive recording medium 3, as shown in FIG. 15. From this time on, the drive timing control unit 17 starts to drive each of the semiconductor lasers 11*d* to 11*a* to record information. That is, the drive timing control unit 17 drives each of the semiconductor lasers 11*d* to 11*h* and does not drive the other semiconductor lasers 11*a* to 11*c*. As a result, the laser beam output from each of the semiconductor lasers 11*d* to 11*h* is reflected by the polygon mirror 2 and applied to each of the print dots d1 to d5. Accordingly, after the print dot d1 is erased, the laser beam from the semiconductor laser 11*d* is first applied to the print dot d1.

Figure 20:
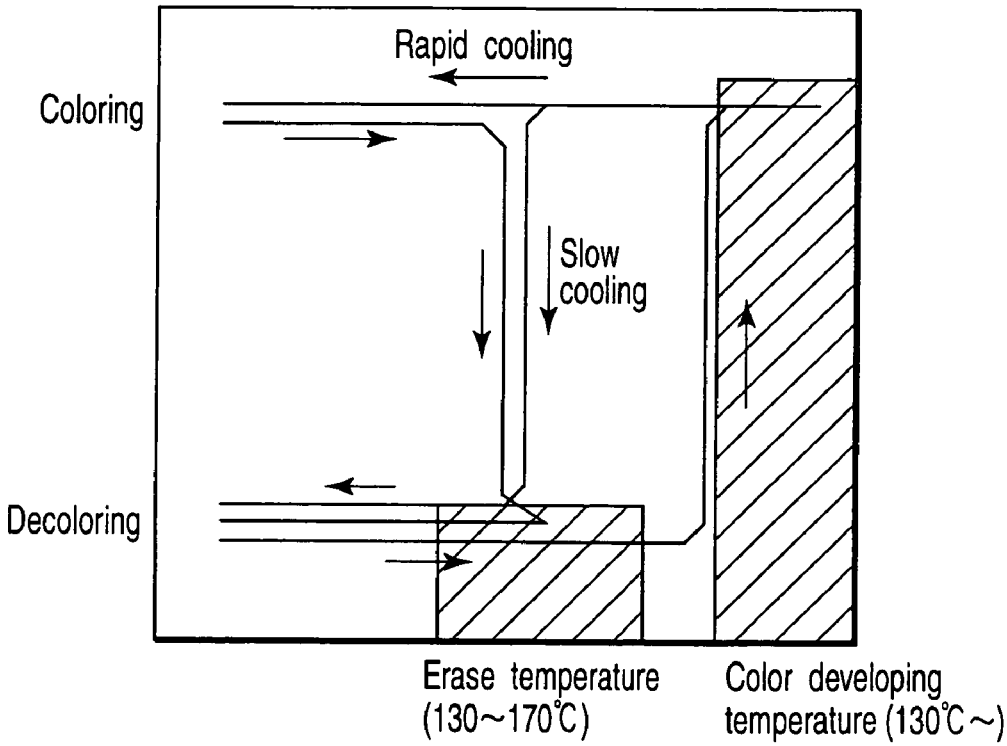
FIG. 20 shows a coloring and decoloring characteristic of a thermosensitive recording medium.

At this time, since a total of 4 laser beams are applied to the print dot d2 consecutively, heat is concentrated on the print dot d2, thereby heating the print dot d2, which then reaches the erase temperature shown in FIG. 20. Consequently, at the print dot d2, the existing print is erased as shown in FIG. 14.

Furthermore, the laser beam from each of the semiconductor lasers 11*f* to 11*h* is applied to the print dot d3 in such a manner that the beams are superimposed on one another consecutively at the print dot d3. Similarly, the laser beam from each of the semiconductor lasers 11*g*, 11*h* is applied to the print dot d4 in such a manner that the beams are superimposed on each other consecutively at the print dot d4. To the print dot d5, the laser beam from the semiconductor laser 11*h* is applied.

Figure 16:
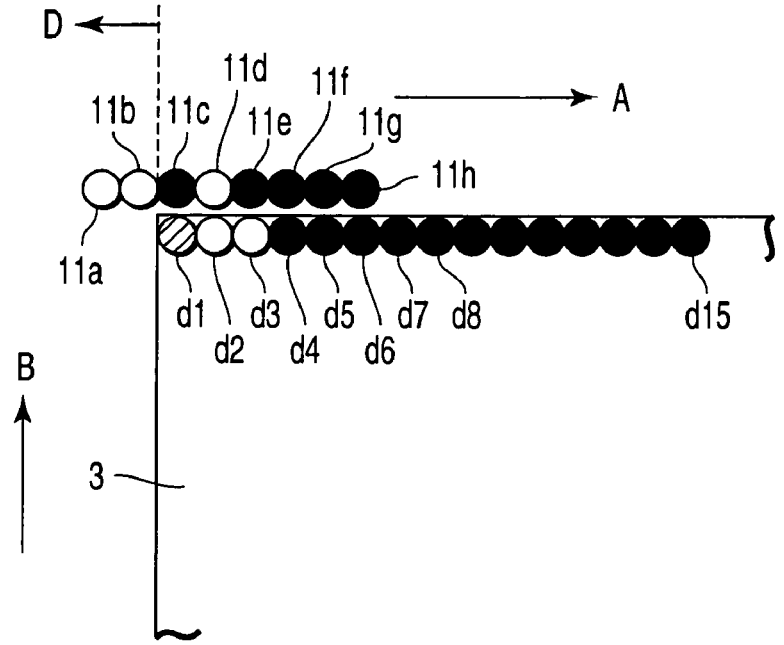
FIG. 16 shows the process of printing the individual print dots onto the thermosensitive recording medium in the recording apparatus.

Next, when 12 μs has elapsed since the operation of recording onto the thermosensitive recording medium 3 was started, the scanning position of the laser beam output from each of the semiconductor lasers 11*e* to 11*h* is located on the print face of the thermosensitive recording medium 3, as shown in FIG. 16. At this time, the drive timing control unit 17 drives each of the semiconductor lasers 11*c*, 11*e* to 11*h* and does not drive the other semiconductor lasers 11*a*, 11*b*, 11*d*. As a result, the laser beam output from each of the semiconductor lasers 11*c*, 11*e* to 11*h* is reflected by the polygon mirror 2 and applied to each of the print dots d1, d3 to d6. Accordingly, the laser beam from the semiconductor laser 11*c* is applied to the print dot d1 so as to be superimposed on the laser beam from the semiconductor laser 11*d* previously applied to the print dot d1.

At this time, since no laser beam is applied to the print dot d2, the state where the existing print has been erased is kept at the print dot d1, as shown in FIG. 16.

Since a total of 4 laser beams are applied to the print dot d3 consecutively, heat is concentrated on the print dot d3, thereby heating the print dot d3, which then reaches the erase temperature shown in FIG. 20. Consequently, at the print dot d3, the existing print is erased as shown in FIG. 16.

Furthermore, the laser beam of each of the semiconductor lasers 11*f* to 11*h* is applied to the print dot d4 in such a manner that the beams are superimposed on one another consecutively at the print dot d4. Similarly, the laser beam of each of the semiconductor lasers 11*g*, 11*h* is applied to the print dot d5 in such a manner that the beams are superimposed on each other consecutively at the print dot d5. To the print dot d6, the laser beam from the semiconductor laser 11*h* is applied.

Figure 17:
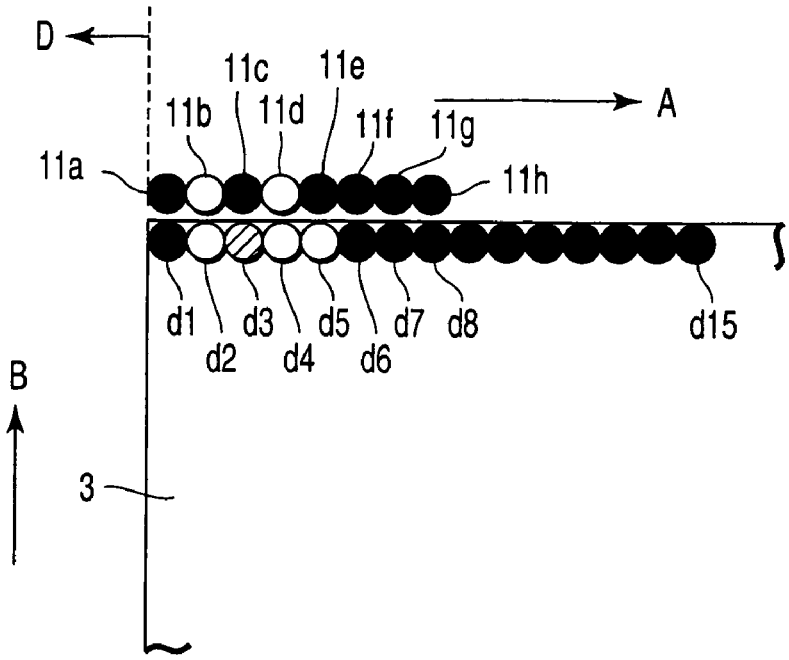
FIG. 17 shows the process of printing the individual print dots onto the thermosensitive recording medium in the recording apparatus.

Next, when 16 μs has elapsed since the operation of recording onto the thermosensitive recording medium 3 was started, the scanning position of the laser beam output from each of the semiconductor lasers 11*a* to 11*h* is located on the print face of the thermosensitive recording medium 3, as shown in FIG. 17. At this time, the drive timing control unit 17 drives each of the semiconductor lasers 11*a*, 11*c*, 11*e* to 11*h* and does not drive the other semiconductor lasers 11*b*, 11*d*. As a result, the laser beam output from each of the semiconductor lasers 11*a*, 11*c*, 11*e* to 11*h* is reflected by the polygon mirror 2 and applied to each of the print dots d1, d3, d5 to d8. Accordingly, the laser beam from each of the semiconductor lasers 11*a* to 11*d* is applied to the print dot d1 consecutively.

Regarding the print dot d1, the laser beam output sequentially from each of the semiconductor lasers 11*a* to 11*d* is applied to the print dot d1 in such a manner that the individual laser beams are superimposed on one another consecutively. As a result, heat is concentrated on the print dot d1, thereby heating the dot d1, which then reaches the color developing temperature (e.g., 180° C.) shown in FIG. 20. Therefore, at the print dot d1, printing is completed with a sufficient density.

At this time, since no laser beam is applied to the print dots d2, d4, the state where the existing print has been erased is kept at the print dots d2, d4 as shown in FIG. 17.

After the print dot d3 is erased, the laser beam from the semiconductor laser 11*c* is first applied to the print dot d3.

Since a total of 4 laser beams are applied to the print dot d5 consecutively, heat is concentrated on the print dot d5, thereby heating the print dot d5, which then reaches the erase temperature shown in FIG. 20. Consequently, at the print dot d5, the existing print is erased as shown in FIG. 17.

Furthermore, the laser beam from each of the semiconductor lasers 11*f* to 11*h* is applied to the print dot d6 in such a manner that the beams are superimposed on one another consecutively at the print dot d6. Similarly, the laser beam from each of the semiconductor lasers 11*g*, 11*h* is applied to the print dot d7 in such a manner that the beams are superimposed on each other consecutively at the print dot d7. To the print dot d8, the laser beam from the semiconductor laser 11*h* is applied.

Similarly, when each of the semiconductor lasers 11*a* to 11*h* has been selectively driven according to each of the print dots d1, d3, d5, d7, d9 and the like, and the scanning position of the laser beam output from each of the semiconductor lasers 11*a* to 11*h* has been caused to scan one line in the main scanning direction A, one line of print dots d1, d3, d7, d9 shown in, for example, FIG. 4 is formed.

On the other hand, if there is no print on the print face of thermosensitive recording medium 3 housed in the recording medium storage box 15, the print face sensor 21 senses the state where there is no print on the thermosensitive recording medium 3 and outputs the sense signal. Alternatively, for example, the operator manually inputs to the print setting unit 22 information that there is no print on the print face of the thermosensitive recording medium 3. Receiving the sense signal output from the print face sensor 21, the print recognition unit 20 determines that there is no print on the print face of the thermosensitive recording medium 3, on the basis of, for example, image data on the print face of the thermosensitive recording medium 3. Alternatively, from the setting state of the print setting unit 22, the print recognition unit 20 determines that there is no print on the print face of the thermosensitive recording medium 3. The print recognition unit 20 sends to the drive timing control unit 17 the result of determining that there is no print on the print face of the thermosensitive recording medium 3.

Receiving the result of determining that there is no print on the print face of the thermosensitive recording medium 3 from the print recognition unit 20, the drive timing control unit 17 causes each of the semiconductor lasers 11*a* to 11*h* to output a laser beam sequentially when the scanning position of the laser beam output from each of the semiconductor lasers 11*a* to 11*h* has reached a position corresponding to the print dot place on the thermosensitive recording medium 3 sequentially as shown in FIG. 3 and FIGS. 5 to 9, thereby applying the laser beams to the print dot place in such a manner that the beams are superimposed on one another at the print dot place. As a result, on the print face of the thermosensitive recording medium 3, one line of print dots d1, d3, d5, d7, d9 is formed as shown in, for example, FIG. 4.

Furthermore, the temperature sensor 23 senses the ambient temperature at the thermosensitive recording medium 3 housed in the recording medium storage box 15 and outputs the sense signal. Receiving the sense signal output from the temperature sensor 23, the drive timing control unit 17 changes the number of semiconductor lasers 11*e* to 11*h* used to erase existing prints according to the ambient temperature at the thermosensitive recording medium 3 housed in the recording medium storage box 15. For example, if the ambient temperature at the thermosensitive recording medium 3 becomes higher than the reference temperature by the specific temperature, the drive timing control unit 17 decreases the number of semiconductor lasers to output a laser beam by one, giving three semiconductor lasers 11*f* to 11*h*. If the ambient temperature at the thermosensitive recording medium 3 becomes lower than the reference temperature by the specific temperature, the drive timing control unit 17 increases the number of semiconductor lasers to output a laser beam by one, giving five semiconductor lasers 11*d* to 11*h*.

As described above, according to the second embodiment, if it has been determined that there is an existing print on the print face of the thermosensitive recording medium 3, the laser beam output from each of a part of the semiconductor lasers 11*a* to 11*h*, for example, the semiconductor lasers 11*e* to 11*h* shown in FIG. 2, is applied to each of the print dots d1 to d9 in such a manner that the beams are superimposed on one another at each of the print dots d1 to d9. As a result, the print face of the thermosensitive recording medium 3 is heated to the erase temperature shown in FIG. 20, which enables the existing print present on the recording face to be erased.

Then, when the scanning position of the laser beam output from each of the remaining semiconductor lasers 11*a* to 11*d* has reached a position corresponding to each of the print dots d1, d3, d5, d7, d9 on the thermosensitive recording medium 3 sequentially, each of the semiconductor lasers 11*a* to 11*d* is caused to output a laser beam. The individual laser beams are applied to each of the print dots d1, d3, d5, d7, d9 in such a manner that the beams are superimposed on one another sequentially. As a result, after the existing print is erased, one line of print dots d1, d3, d5, d7, d9 shown in, for example, FIG. 4 is formed on the print face of the thermosensitive recording medium 3.

Accordingly, the second embodiment produces the same effect as that of the first embodiment. That is, with the second embodiment, it is possible to realize a high-speed recording operation without a substantial rise in costs merely by using the laser array head 10 composed of the minimum necessary number of inexpensive semiconductor lasers, for example, 8 semiconductor lasers 11*a* to 11*h*, arranged in a line without using a laser apparatus, such as a high-power gas laser.

On the basis of the sense signal output from the print face sensor 21 or the setting state of the print setting unit 22, the print recognition unit 20 determines whether there is an existing print on the print face of the thermosensitive recording medium 3. Thus, if there is no existing print on the print face of the thermosensitive recording medium 3, the print face of the thermosensitive recording medium 3 can be raised to the color developing temperature, thereby recording image data including images and characters, as in the first embodiment. If there is an existing print on the print face of the thermosensitive recording medium 3, after the existing print is erased, the print face of the thermosensitive recording medium 3 can be raised to the color developing temperature, thereby recording image data including images and characters.

Accordingly, even if an existing print is present on the print face of the thermosensitive recording medium 3, information can be recorded automatically on the print face of the thermosensitive recording medium 3 by switching between a case where there is an existing print or case where there is no existing print on the print face of the thermosensitive recording medium 3 according to the state of the print face of the thermosensitive recording medium 3.

If there is no existing print on the print face of the thermosensitive recording medium 3, since each of a part of the semiconductor lasers 11*a* to 11*h*, for example, each of the semiconductor lasers 11*e* to 11*h* shown in FIG. 2, is not driven for each of the print dots d1 to d15 to output a laser beam, the power consumption can be reduced.

According to the ambient temperature at the thermosensitive recording medium 3, the number of semiconductor lasers 11*e* to 11*h* used to erase existing prints is changed. This reduces the number of semiconductor lasers to output a laser beam by at least one when the apparatus is used in a high-temperature environment. For example, the laser beam output from each of the three semiconductor lasers 11*f* to 11*h* is applied to a print dot where an existing print is present, thereby enabling the existing print to be erased.

This invention is not limited to the above embodiments and may be embodied by modifying the component elements without departing from the spirit or essential character thereof. In addition, various inventions may be formed by combining suitably a plurality of component elements disclosed in the embodiments. For example, some elements may be removed from all of the component elements constituting the embodiments. Furthermore, component elements used in two or more embodiments may be combined suitably.

While in each of the above embodiments, the thermosensitive recording medium is composed of a protective layer/a color-producing layer/a base material, it may be composed of a protective layer/a photothermal conversion layer/a color-producing layer/a base material. In the latter case, it is possible to concentrate light by superimposing laser beams on one another, convert the concentrated light into heat with the photothermal conversion layer, and concentrate the resulting heat.

While in each of the embodiments, the number of semiconductor lasers 11*a* to 11*h* has been, for example, 8, the invention is not limited to this. For instance, the number of semiconductor lasers 11*a* to 11*h* may be set according to the magnitude of the laser power of each of the semiconductor lasers 11*a* to 11*h* or the temperature environment of the apparatus. Moreover, the laser power of each of the semiconductor lasers 11*a* to 11*h* may be varied according to the number of semiconductor lasers 11*a* to 11*h*.

Although in each of the embodiments, the laser array head 10 which forms each print dot by applying a laser beam onto the thermosensitive recording medium 3 has been used, the invention is not limited to this. For instance, the invention may be applied to an ink-jet recording apparatus which forms an image by dropping, for example, black (K), cyan (C), magenta (M), and yellow (Y) inks on a recording medium, such as recording paper. In this case, the KCMY inks output from the ink-jet record head are dropped separately on the same print dot, such as each of the print dots d1, d3, d5, d7, d9, on the recording medium in such a manner that the inks are superimposed on one another sequentially at the dot at the same time that the ink-jet record head is moved in the main scanning direction A1. This enables a print dot d1 with the optimum density to be formed by dropping, for example, a number, K, of color inks on the print dot d1 in such a manner that the inks are superimposed on one another sequentially at the dot.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A recording apparatus with a record head comprising:

the record head which is composed of a plurality of laser light sources arranged in a line;

a transport mechanism which transports a recording medium;

a recording control unit which not only causes a laser beam output from each of the laser light sources to scan in a main scanning direction perpendicular to a transporting direction of the recording medium by the transport mechanism, but also drives the transport mechanism to transport the recording medium in a vertical sub-scanning direction perpendicular to the main scanning direction of the record head and records information on the recording medium; and a drive timing control unit which, if a scanning position of the laser beam output from each of the laser light sources has reached a position corresponding to a printing place to record the information on the recording medium sequentially, causes each of the laser light sources to output a laser beam sequentially, applies the laser beams to the printing place in such a manner that the beams are superimposed on one another to heat the printing place to a color developing temperature, and is capable of varying the number of the parts of the laser light sources caused to output the laser beams according to an ambient temperature.

2. The recording apparatus with a record head according to claim 1, wherein the recording medium has at least a rewritable thermosensitive recording medium capable of thermosensitive recording.

3. The recording apparatus with a record head according to claim 2, wherein the drive timing control unit applies each of the laser beams to the thermosensitive recording medium in such a manner that the laser beams are superimposed on one another and concentrates heat or light on the thermosensitive recording medium to heat the recording medium.

4. The recording apparatus with a record head according to claim 2, wherein the drive timing control unit applies the laser beams output from two or more of the laser light sources to the thermosensitive recording medium in such a manner that the beams are superimposed on one another sequentially and, when the scanning positions of the laser beams output from the remaining laser light sources have reached positions corresponding to associated printing places on the thermosensitive recording medium sequentially, causes each of the plurality of laser light sources to output a laser beam sequentially, and applies each of the laser beams to the printing place in such a manner that the beams are superimposed on one another to heat the printing place to a color developing temperature.

5. The recording apparatus with a record head according to claim 4, wherein the drive timing control unit causes each of the part of the laser light sources to output a laser beam and applies each of the laser beams to the thermosensitive recording medium in such a manner that the beams are superimposed on one another to preheat the thermosensitive recording medium.

6. The recording apparatus with a record head according to claim 1, wherein the drive timing control unit varies the timing of the recording operation on the recording medium according to the transport speed of the recording medium.

7. A recording method using a record head comprising:

if a recording medium is transported and, in the record head composed of a plurality of laser light sources arranged in a line, information is recorded on the recording medium by scanning each laser beam output from each of the laser light sources on the recording medium;

wherein a direction perpendicular to a transporting direction of the recording medium is a main scanning direction and a sub-direction scanning said each laser beam on the recording medium, the direction perpendicular to the main scanning direction is a vertical scanning direction;

if a scanning position of the laser beam output from each of the laser light sources has reached a position corresponding to a printing place to record the information on the recording medium sequentially, causing each of the laser light sources to output a laser beam sequentially, applying the laser beams to the printing place in such a manner that the beams are superimposed on one another to heat the printing place to a color developing temperature, and varying the number of the parts of the laser light sources caused to output the laser beams according to an ambient temperature.

8. A recording apparatus comprising:

a head including a plurality of aligned lasers;

a transport mechanism configured to transport a recording medium;

a recording control unit configured to direct outputs from each of the lasers along the recording medium in a first direction and a second direction perpendicular to the first direction to record information on the recording medium; and a drive timing control unit configured to:

sequentially direct outputs from the different lasers to a printing location on the recording medium such that the outputs are superimposed on one another to heat the printing location to a color developing temperature; and vary the number of outputs of the lasers directed to the printing location depending on an ambient temperature.

9. The recording apparatus of claim 8, wherein the outputs from the lasers are reflected onto the recording medium by a rotatable polygon mirror.

10. The recording apparatus of claim 8, wherein the recording medium is a rewritable thermosensitive recording medium.

11. The recording apparatus of claim 8, wherein the drive timing control unit is configured to concentrate heat of the outputs at the printing location.

12. The recording apparatus of claim 8, wherein the outputs include laser light.

13. The recording apparatus of claim 8, wherein the drive timing control unit is configured to vary the number of outputs of the lasers directed to the printing location depending on a speed of the transport mechanism.

14. The recording apparatus of claim 8, wherein the drive timing control unit is configured to direct the outputs to a plurality of different printing locations on the recording medium and superimpose the outputs at each of the plurality of different printing locations to heat each of the plurality of different printing locations to the color developing temperature.

15. A recording method using a record head comprising:

transporting a recording medium in a first direction;

directing outputs from a plurality of lasers aligned in a head along the recording medium in the first direction and a second direction perpendicular to the first direction to record information on the recording medium;

sequentially directing the outputs from the different lasers to a printing location on the recording medium such that the outputs are superimposed on one another to heat the printing location to a color developing temperature using a drive timing control unit; and varying the number of outputs of the lasers directed to the printing location depending on an ambient temperature using the drive timing control unit.

16. The recording method of claim 15, further comprising directing the outputs to a plurality of different printing locations on the recording medium and superimposing the outputs at each of the plurality of different printing locations to heat each of the plurality of different printing locations to a color developing temperature.

17. The recording method of claim 15, wherein the recording medium is a rewritable thermosensitive recording medium.

18. The recording method of claim 15, further comprising concentrating heat of the outputs at the printing location.

19. The recording method of claim 15, wherein the outputs include laser light.

20. The recording method of claim 15, further comprising varying the number of outputs of the lasers directed to the printing location depending on a speed of the transport mechanism.

* * * * *